US005500499A

United States Patent [19]

Seki et al.

[11] Patent Number: 5,500,499

[45] Date of Patent: Mar. 19, 1996

[54] CONTACTS MATERIAL FOR VACUUM VALVE

[75] Inventors: Tsuneyo Seki, Tokyo; Tsutomu Okutomi, Kanagawa; Atsushi Yamamoto, Tokyo, all of Japan

[73] Assignee: Kabushiki Kaisha Toshiba, Kawasaki, Japan

[21] Appl. No.: 181,085

[22] Filed: Jan. 13, 1994

[30] Foreign Application Priority Data

Feb. 2, 1993 [JP] Japan ..... 5-015060

[51] Int. Cl.[6] ..... H01H 33/66

[52] U.S. Cl. ..... 218/130; 218/123

[58] Field of Search ..... 200/144 R, 144 B, 200/262, 264, 265, 266, 262; 218/118, 123, 130, 146

[56] References Cited

U.S. PATENT DOCUMENTS

| | | | |
|---|---|---|---|
| 4,640,999 | 2/1987 | Kashiwagi et al. | 200/144 B |
| 4,743,718 | 5/1988 | Santilli | 200/144 B |
| 4,830,821 | 5/1989 | Okutomi et al. | 419/25 |

FOREIGN PATENT DOCUMENTS

| | | |
|---|---|---|
| 0101024 | 2/1984 | European Pat. Off. . |
| 0109088 | 5/1984 | European Pat. Off. . |
| 0110176 | 6/1984 | European Pat. Off. . |
| 59-201331 | 11/1984 | Japan . |
| 59-201333 | 11/1984 | Japan . |
| 59-201334 | 11/1984 | Japan . |
| 59-201335 | 11/1984 | Japan . |

*Primary Examiner*—Kristine L. Kincaid
*Assistant Examiner*—Michael A. Friedhofer
*Attorney, Agent, or Firm*—Oblon, Spivak, McClelland, Maier, & Neustadt

[57] ABSTRACT

A contacts material for a vacuum valve including an arc-proof constituent including at least one selected from the group of chromium, titanium, zirconium, vanadium and yttrium, an auxiliary constituent including at least one selected from the group of tantalum, niobium, tungsten and molybdenum and a conductive constituent including at least one selected from the group of copper and silver. In the contacts material, an amount of the arc-proof constituent is from 10% to 70% by volume, a total amount of the arc-proof constituent together with the auxiliary constituent is not more than 75% by volume and an amount of the conductive constituent is the balance.

7 Claims, 1 Drawing Sheet

CONTACTS MATERIAL FOR VACUUM VALVE

BACKGROUND OF THE INVENTION

1. Field of the Invention

This invention relates to a contacts material for a vacuum valve of improved breaking performance.

2. Description of the Related Art

Apart from the fundamental three performance requirements: anti-welding property, voltage withstanding capability and current interrupting property, the characteristics required for contacts materials for vacuum valves include as important requirements low and stable rise in temperature and low and stable contacts resistance. However, some of these requirements are mutually antagonistic, so it is difficult to satisfy all the requirements by a single metal. In the many contacts materials which have been implemented, contacts materials have therefore been developed by combining two or more elements so as to mutually complement the deficiencies of each others performance, and to meet specific applications such as large current use or high withstanding voltage use, and they have excellent characteristics in their own way. However, performance in respect of increasingly severe requirements still leaves something to be desired.

For example, in contacts materials for the vacuum valve for general-use circuit breakers, in initial development of vacuum valves, anti-welding property was emphasized. It was therefore the practice to add a welding preventing constituent such as Te or Bi in the amount of not more than 10 weight %, with Cu as main constituent (see for example issued Japanese Patent Publication (Kokoku) Nos. Sho. 41-12131, Sho. 44-23751). However, with demands such as increase in the field of use, miniaturization and price reduction of vacuum circuit breakers and vacuum valves, contacts having breaking performance better than that of the conventional Cu—Te or Cu—Bi contacts have come to be demanded. As a result, Cu—Cr contacts, which have better breaking performance than conventional contacts, have come to be the most common. Nevertheless, the present situation is that contacts having even better breaking capability are being demanded.

The reason why Cu—Cr contacts have better breaking performance than Cu—Bi or Cu—Te contacts is thought to be that the arc-proof material Cr has a getter action, and that the getter action can be displayed to advantage since Cr can easily form a plasma vapor, due to its appropriate vapor pressure and melting point.

With this in view, the inventors carried out breaking tests on contacts materials manufactured by a sintering method or melting method using conductive constituents and arc-proof materials such as Ti, Zr, V, or Y having a larger getter action than Cr and a more appropriate vapor pressure and melting point than CF. In the JEC4 test, here JEC is the abbreviation for Japan Electrotechnical Committee Standard, of repeated contact closure and contact opening, better performance was obtained than with the conventional Cu—Cr contacts. However, in the JEC5 test, in which breaking is performed after passing current for a fixed time, good performance was not obtained, in that welding tended to occur. It would therefore be difficult to say that sufficient breaking performance is obtained with this concept, alone, and reliability was lacking.

SUMMARY OF THE INVENTION

Accordingly, one object of this invention is to provide contacts material for vacuum valve having excellent breaking performance.

The inventors surmised that the reason why good breaking performance was not obtained in the JEC5 test described above was that these Ti, Zr, V, or Y arc-proof constituents formed a solid solution with the conductive constituent or formed intermetallic compounds, thereby greatly lowering the electrical conductivity of the contacts material, resulting in increased contacts resistance, leading to the occurrence of the welding by the Joule heat. They therefore thought that breaking capability could be greatly increased if the conductivity of the contacts material could be raised to that of the prior art contacts material while employing Ti, Zr, V, or Y as arc-proof constituent.

They thereby discovered the contacts material in which at least one of Ti, Zr, V, Y or Cr, which is capable of raising breaking capability to some degree, is used as arc-proof material, and, in order to maintain conductivity of the contacts material, the surface of the arc-proof material is covered with at least one auxiliary constituent consisting of Ta, Nb, W, or Mo.

These and other objects of this invention can be achieved by providing a contacts material for a vacuum valve including an arc-proof constituent including at least one selected from the group consisting of chromium, titanium, zirconium, vanadium and yttrium, an auxiliary constituent including at least one selected from the group consisting of tantalum, niobium, tungsten and molybdenum and a conductive constituent including at least one selected from the group consisting of copper and silver. In the contacts material, an amount of the arc-proof constituent is from 10% to 70% by volume, a total amount of the arc-proof constituent together with the auxiliary constituent is not more than 75% by volume and an amount of the conductive constituent is the balance.

According to one aspect of this invention, there is provided a contacts material for a vacuum valve including composite powders, each having an auxiliary constituent and an arc-proof constituent covered with the auxiliary constituent and a conductive constituent including at least one selected from the group consisting of copper and silver. In the contacts material, the arc-proof constituent includes at least one selected from the group consisting of chromium, titanium zirconium, vanadium and yttrium and the auxiliary constituent includes at least one selected from the group consisting of tantalum, niobium, tungsten and molybdenum.

Details of the action are as follows. Specifically, Ti, Zr, V, Y and Cr have suitable melting point and vapor pressure and provide a getter action; they are therefore promising as arc-proof materials for raising the breaking capability. However, such arc-proof materials form solid solutions to an appreciable extent with the conductive constituent Cu or Ag, or form various intermetallic compounds. If therefore the conductive constituent and arc-proof constituent are simply melted, intermetallic compounds are formed between the arc-proof constituent and conductive constituent, with the result that the α-phase portion of the conductive constituent, which should provide the conductive constituent matrix of the contacts, is greatly reduced.

Furthermore, the conductivity of the contacts material tends to be lowered, since arc-proof constituent is melted in the α-phase of the conductive constituent to some degree. For these two reasons, sufficient conductivity of the contacts material cannot be obtained. Also, even if manufacture is carried out by a sintering method in which arc-proof constituent powder and conductive constituent powder are mixed, molded by pressuring and sintered, a phase of intermetallic compounds having the lower melting point than that of the conductive constituent is formed. So that sintering at the low temperature of for example 900 K must be employed, and sufficient hardness for use as a contacts material is not obtained, due to this low-temperature sintering. From this standpoint it is desirable to alloy the arc-proof constituent and auxiliary constituent to some degree.

For the above reasons, it is beneficial to prevent to the utmost reaction between the arc-proof constituent and conductive constituent. The inventors discovered that this could be achieved by covering the arc-proof material with an auxiliary constituent that did not react with the conductive constituent. That is, by covering the surface of the arc-proof constituent with an auxiliary material that does not react with the conductive constituent of Cu or Ag, such as for example W or Mo, then by forming a composite with the conductive constituent, the reaction between the arc-proof constituent and conductive constituent is prevented. As a result, suitable conductivity for use as a contacts material is obtained. This therefore contributes to raising breaking performance.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
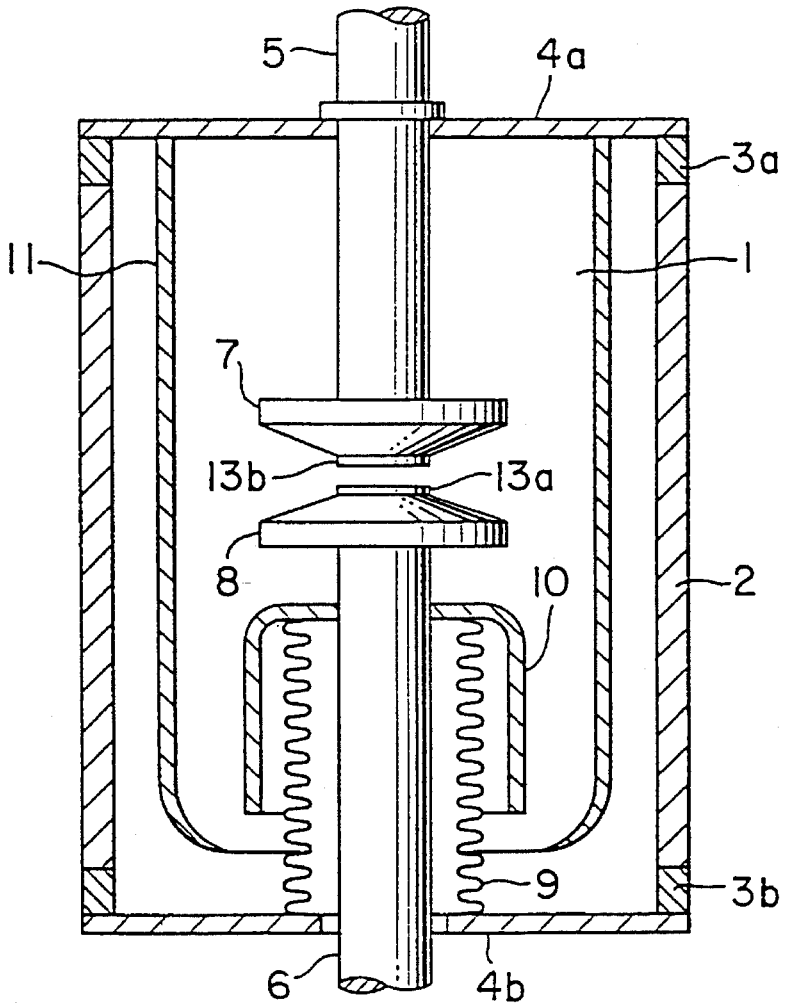
FIG. 1 is a cross-sectional view of a vacuum valve to which a contacts material for the vacuum valve according to this invention is applied.
Figure 2:
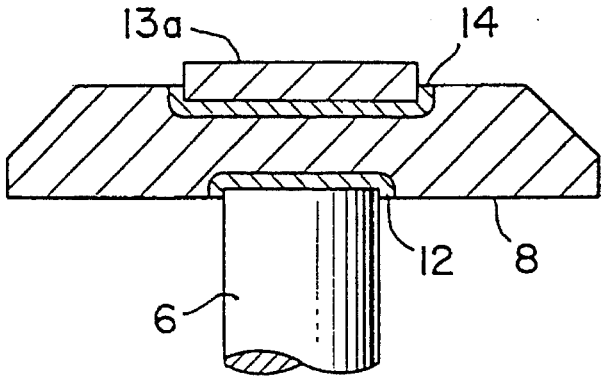
FIG. 2 is an enlarged cross-sectional view of the electrode portion of the vacuum valve shown in FIG. 1.

Embodiments of this invention are described below with reference to the drawings. FIG. 1 is a cross-sectional view of a vacuum valve. FIG. 2 is a view to a larger scale of the electrode portion of the vacuum valve shown in FIG. 1.

In FIG. 1, a circuit breaking chamber 1 is constituted by an insulating vessel 2 formed practically on a cylinder by insulating material and metal covers 4*a*, 4*b* provided at both ends thereof, with interposition of sealing fitments 3*a* and 3*b*, the chamber being maintained under vacuum.

Circuit breaking chamber 1 has arranged within it a pair of electrodes 7 and 8 mounted at facing ends of conductive rods 5 and 6. For example upper electrode 7 is the fixed electrode, while lower electrode 8 is the movable electrode. A bellows 9 is fitted to conductive rod 6 of this electrode 8, so that movement in the axial direction of electrode 8 can be performed whilst maintaining vacuum-tightness within circuit breaking chamber 1. A metal arc shield 10 is provided at the top of the bellows 9 to prevent bellows 9 being covered by arc vapor. A metal arc shield 11 is provided in circuit breaking chamber 1 so as to cover electrodes 7 and 8, to prevent insulating vessel 2 being covered by arc vapor.

As shown in FIG. 2, electrode 8 is fixed to conductive rod 6 by a brazing portion 12, or is press-fitted by caulking. A contact 13*a* is mounted on electrode 8 by brazing a portion 14. Essentially the same construction is adopted for electrode 7.

Next, examples of a method of manufacturing contacts material according to this invention will be described. Methods of manufacturing contacts material can be broadly classified into the infiltration method, wherein the conductive constituent is melted and allowed to flow into a skeleton formed of the arc-proof powder etc., and the sintering method, in which the powders are mixed in prescribed proportions and molded by pressuring and sintered.

In this invention, in both methods, a composite powder is employed that is obtained by covering arc-proof powder with the auxiliary constituent. The method of covering may be by any method such as for example PVD or CVD, but, from the point of view of the vacuum components, PVD is preferable since the gas content can be reduced. Here, PVD and CVD are the abbreviations for Physical Vapor Deposit and Chemical Vapor Deposit, respectively.

In the case of the infiltration method, the characterizing feature of this invention consists in manufacturing a skeleton by sintering this composite powder under for example vacuum atmosphere, and manufacturing contacts by infiltrating conductive constituent into this skeleton for example under vacuum atmosphere. In the case of the sintering method, the feature is that a mixed powder of composite powder as described above and conductive powder blended in the prescribed amounts is molded by pressuring and then contacts are manufactured by sintering for example under vacuum. On observing the cross-sectional structure of the contacts that were thus manufactured, an alloy phase was observed between the arc-proof constituent and auxiliary constituent.

Next, methods of evaluation and evaluation conditions for specific Examples obtained as will be described are explained.

(1) Conductivity

The Examples are measured using a conductivity meter named "sigma tester".

(2) Breaking test

The contacts of this invention and prior art contacts were compared from the point of view described above. Disc-shaped sample of contacts material of diameter 30 mm, thickness 5 mm was subjected to a circuit breaking test in which it was mounted in a demountable type vacuum valve, the recovery voltage being fixed at 7.2 kV, and the circuit breaking current was gradually increased until circuit breaking could no longer be performed. Circuit breaking capability was expressed as a relative value, taking the circuit breaking capability of the conventional Cu—Cr contacts as 1.0. For fixing the contacts, only baking heating (450° C. for 30 minutes) was employed. Brazing material was not used and the heating which would accompany this was not performed.

In the manufacture of Tables 2 to 4 below, a composite powder was employed obtained by covering the surface of the arc-proof constituent with auxiliary constituent.

TABLE 1

| | Chemical constituents (vol %) | | | Conductivity | Breaking capability | | |
|---|---|---|---|---|---|---|---|
| | Ti | W | Cu | (% IACS) | Test 4 | Test 5 | Notes |
| Comparative example 1 | 0 | 0 | Bal | 30 | 1.0 | 1.0 | Cr = 50% standard contacts |
| Comparative Example 2 | 40 | 0 | Bal | <8 | 1.0 | 0.6 | Melting method |
| Comparative Example 3 | 40 | 5 | Bal | <8 | 1.1 | 0.7 | Melting method |
| Comparative Example 4 | 40 | 5 | Bal | . . . | . . . | . . . | sintering method, not possible |

TABLE 2

| | Chemical constituents (vol %) | | | Conductivity | Breaking capability | | |
|---|---|---|---|---|---|---|---|
| | Ti | W | Cu | (% IACS) | Test 4 | Test 5 | Notes |
| Example 1 | 40 | 2 | Bal | 40 | 1.2 | 1.2 | |
| Example 2 | 40 | 10 | Bal | 35 | 1.2 | 1.2 | |
| Example 3 | 40 | 30 | Bal | 25 | 1.2 | 1.2 | |
| Comparative example 5 | 40 | 40 | Bal | 15 | 1.1 | 0.9 | high contact resistance |

TABLE 3

| | Chemical constituents (vol %) | | | Conductivity | Breaking capability | | |
|---|---|---|---|---|---|---|---|
| | V | Ta | Cu | (% IACS) | Test 4 | Test 5 | Notes |
| Comparative example 6 | 5 | 5 | Bal | 60 | 0.8 | 0.8 | Insufficient breaking capability |
| Example 4 | 10 | 5 | Bal | 50 | 1.1 | 1.1 | |
| Example 5 | 25 | 5 | Bal | 40 | 1.2 | 1.2 | |
| Example 6 | 50 | 5 | Bal | 35 | 1.2 | 1.2 | |
| Example 7 | 70 | 5 | Bal | 25 | 1.2 | 1.2 | |
| Comparative example 7 | 90 | 5 | Bal | 10 | 1.1 | 0.9 | high contact resistance |

TABLE 4

| | chemical constituents (vol %) | | | | | | Conductivity | Breaking capability | |
|---|---|---|---|---|---|---|---|---|---|
| | Zr | Y | Mo | Nb | Cu | Ag | (% IACS) | Test 4 | Test 5 |
| Example 8 | 45 | 0 | 5 | 5 | 30 | 15 | 30 | 1.0 | 1.0 |
| Example 9 | 30 | 20 | 5 | 0 | Bal | 0 | 30 | 1.2 | 1.2 |

Comparative Examples 1 to 4 (see Table 1)

The Cu—Cr contacts used to provide the standard for the relative comparison of the circuit breaking test were manufactured by infiltrating Cu into a Cr skeleton (Comparative example 1). In order to elucidate the difference with this invention, 40 Ti—Cu contacts and 40 Ti—5W—Cu contacts were manufactured in a vacuum melting furnace (Comparative examples 2 and 3). Furthermore, manufacture of contacts material was attempted by the sintering method by mixing Ti powder, W powder and Cu powder, followed by molding by pressuring and sintering. However, if the sintering temperature was above 750° C., the original shape of the molded body could not be maintained due to severe melting of Ti into Cu. On the other hand, if the sintering temperature was lower, the material strength could not be maintained. This trial manufacture of these contacts was therefore unsuccessful (Comparative example 4).

The detailed conditions for manufacturing these samples are described below.

CONDITION for Comparative Example 1

Cr powders having an average grain size of 100 micrometers were filled in a carbon crucible, and were sintered at a temperature of 1200° C. for one hour under a vacuum of $10^{-3}$ Pa to obtain a skeleton. An oxygen-free copper block was put on the skeleton and was melted at a temperature of 1150° C. for 0.5 hours under a vacuum of $10^{-3}$ Pa. As a result, copper was infiltrated into the Cr skeleton to obtain a sample of a contacts material.

CONDITION for Comparative Example 2

In a vacuum high frequency induction melting furnace, copper was melted in an aluminum oxide crucible. Then argon was introduced to a pressure of 150 Tort and titanium was added by a prescribed value. After titanium was melted, the resultant melting body was cast in a prescribed crucible to obtain a sample of a contacts material which is 40 Ti—Cu.

CONDITION for Comparative Example 3

In a vacuum high frequency induction melting furnace, copper was melted in an aluminum oxide crucible. Then argon was introduced to a pressure of 150 Tort and titanium of a prescribed value was added. Next, tungsten was added and after mixing by stirring, the resultant was cast in a prescribed crucible to obtain a sample of a contacts material which is 40 Ti—5W—Cu.

CONDITION for Comparative Example 4

Titanium powders, tungsten powders and copper powders having an average grain size of 100, 3 and 40 micrometers, respectively, were mixed in the ratio of 8:1:11. The mixed was molded by pressuring with a molding pressure of 8 metric tons per square centimeter to obtain a molded body. Then when the molded body was sintered at a temperature of 850° C. for one hour under a vacuum of a $10^{-3}$ Pa, titanium was melted into copper severely, with the result that the original shape of the molded body could not be maintained.

In the condition of 750° C. for one hour, the result was the same.

Evaluation was therefore conducted on Comparative examples 1 to 3 described above. The Cu—Cr contacts of Comparative example 1 were of conductivity 30% IACS. Here, IACS is the abbreviation for International Annealed Copper Standard. In order to provide a comparison standard for the subsequent Comparative examples and Examples, the circuit breaking capability of these contacts was taken as 1.0.

In contrast, in the case of Comparative examples 2 and 3 manufactured by the prior art melting method, good conductivity was not obtained, owing to the melting of Ti into the Cu phase and the formation of Cu—Ti type intermetallic compounds.

Also in the circuit breaking test of Comparative examples 2 and 3 , although a value of the same order as that of the Cu—Cr contacts was obtained in the No. 4 test, in the No. 5 test, performance was inferior to that of the Cu—Cr contacts, due to the occurrence of melding.

Examples 1 to 3 and Comparative Example 5 (see Table 2)

Ti—W—Cu contacts were manufactured by infiltrating Cu into a skeleton manufactured using a composite powder obtained by coating Ti powder with W, the Ti content being kept constant at 40 per cent. The content of W which coated Ehe Ti powder was, variously, 2, 10, 30, and 40% (respectively, Examples 1, 2 and 3 and Comparative example 5).

The detailed conditions for manufacturing these samples are described below.

CONDITION for Example 1

Titanium powders having an average grain size of 100 micrometers were coated mechanically with tungsten powders having an average grain size of 3 micrometers to prepare composite powders. The composition of the composite powder was approximately 5 vol % W—Ti by the analysis of the composite powder. The composite powders were then filled in an aluminum oxide crucible and were sintered at a temperature of 1150° C. for one hour under a vacuum of $10^{-3}$ Pa to obtain a skeleton. An oxygen-free copper was infiltrated into the skeleton at a temperature of 1150° C. for 0.5 hours under a vacuum of $10^{-3}$ Pa to obtain a sample of a contacts material.

CONDITION for Example 2

The same powders as in Example 1 were used, but the thickness of the coating of tungsten of the composite powder was made larger. As a result, the composite powders were obtained, whose composition was 10 vol % W—Ti according to the analysis of the composite powder. The following condition was the same as in Example 1 , and a sample of a contacts material was obtained.

CONDITION for Example 3

The same composite powders as in Example 2 were used, whose composition was 10 vol % W—Ti. Tungsten powders were further added to the composite powders so that the ratio of Ti:W was 4:3, and then were mixed. The mixed was then molded by pressuring with a molding pressure of 2 metric tons per square centimeter to obtain a molded body. The following sintering and infiltration conditions were the same as in Examples 1 and 2, and a sample of a contacts material was obtained.

CONDITION for Comparative Example 5

The same composite powders as in Example 2 were used, whose composition was 10 vol % W—Ti. Tungsten powders were further added to the composite powders so that the ratio of Ti:W was 4:4, and then were mixed. The mixed was then molded by pressuring with a molding pressure of 3 metric tons per square centimeter to obtain a molded body. The following sintering and infiltration conditions were the same as in Example 3, and a sample of a contacts material was obtained.

Conductivity tended to decrease as W addition increased. Circuit breaking performance in the No. 4 test in all cases exceeded that of the Cu—Cr contacts by 10 to 20 % but, in the No. 5 test, the welding by the Joule heat occurred in the case of Comparative example 5, in which the amount of auxiliary constituent was excessive, with the result that it proved incapable of displaying a performance comparable with the Cu—Cr contacts.

Examples 4 to 7 and Comparative examples 6, 7 (see Table 3)

Contacts were manufactured in which the amount of added V, which is the arc-proof powder, was varied, with the Ta covering amount fixed at 5%. The added amounts of V were respectively 5, 10, 25, 70 and 90% (Comparative example 6, Examples 4, 5, 6, 7 and Comparative example 7). The contacts with V addition of 5, 10 and 25% were manufactured by the sintering method. The rest were manufactured by the infiltration method.

The detailed conditions for manufacturing these samples are described below.

CONDITION for Comparative Example 6

Vanadium powders having an average grain size of 100 micrometers were coated mechanically with tantalum powders having an average grain size of 3 micrometers to prepare composite powders. The composite powders and copper powders having an average grain size of 40 micrometers were mixed in the volume ratio of 1:9. The mixed was molded by pressuring with a molding pressure of 8 metric tons per square centimeter to obtain a molded body. Then the molded body was sintered at a temperature of 950 ° C. for one hour under a vacuum of $10^{-3}$ Pa to obtain a sample of a contacts material.

CONDITION for Examples 4 and 5

The condition was the same as the condition for Comparative example 6, except the volume ratio of V:Ta. The ratio was adjusted by the thickness of the coating of the composite powders.

CONDITION for Example 6

Vanadium powders having an average grain size of 100 micrometers were coated mechanically with tantalum powders having an average grain size of 3 micrometers to prepare composite powders. The volume ratio of V:Ta was adjusted by the thickness of the coating of the composite powders.

The composite powders were filled in an aluminum oxide crucible and were sintered at a temperature of 1200° C. for one hour under a vacuum of $10^{-3}$ Pa to obtain a skeleton. An oxygen-free copper was infiltrated into the skeleton at a temperature of 1150° C. for 0.5 hours under a vacuum of $10^{-3}$ Pa to obtain a sample of a contacts material.

CONDITION for Example 7

The same composite powders as in Example 6 were used. The composite powders were molded by pressuring with a molding pressure of one metric tons per square centimeter to obtain a molded body. Then the molded body was sintered at a temperature of 1200° C. for one hour under a vacuum of $10^{-3}$ Pa to obtain a skeleton. An oxygen-free copper was infiltrated into the skeleton at a temperature of 1150° C. for 0.5 hours under a vacuum of $10^{-3}$ Pa to obtain a sample of a contacts material.

CONDITION for Comparative Example 7

The condition is the same as in Example 7, except that the molding pressure is 2 metric tons per square centimeter.

As in Table 2, conductivity tended to fall with increase in the arc-proof constituent. The circuit breaking capability for Comparative example 6, in which the added amount of V was small at 5%, was inferior to that of the Cu—Cr contacts in both tests Nos. 4 and 5.

The contacts of Examples 4, 5, 6 and 7 where the added amounts of V were 10, 25, 50 and 70%, respectively, all showed better breaking performance than the Cu—Cr contacts. In the case of Comparative example 7, where the added amount of V was 90%, performance better than that of the Cu—Cr contacts was obtained in test No. 4, but, in test No. 5, owing to the occurrence of welding, performance comparable with that of the Cu—Cr contacts could not be obtained.

From the above Examples 1 to 7 and Comparative examples 5 to 7, it can be seen that addition of at least 10 volume % of arc-proof constituent is necessary, and it is important to keep the total amount of arc-proof constituent and auxiliary constituent below 75%.

Examples 8 to 9 (see Table 4)

In Table 2, the cases based on Ti—W—Cu type, and in Table 3 the cases based on V—Ta—Cu type were described. However, breaking performance can likewise be improved using as arc-proof material not just Ti or V but also Zr, Y or Cr, or by using as auxiliary constituent not just W or Ta but also Mo or Nb. Also, instead of Cu, Ag could be used as conductive constituent.

Specifically, Example 8 consists in contacts of 45 Zr—5 Mo—30 Cu—15 Ag, while Example 9 consists in contacts of 30 Zr—20 Y—5 Mo—Cu; each of these were manufactured by the infiltration method, covering the surface of the arc-proof material with auxiliary constituent.

The detailed conditions for manufacturing these samples are described below.

CONDITION for Example 8

Zirconium powders having an average grain size of 100 micrometers were coated mechanically with molybdenum powders and niobium powders having an average grain size of 3 micrometers, respectively, to prepare composite powders. The composite powders were filled in an aluminum oxide crucible and were sintered at a temperature of 1200° C. for one hour under a vacuum of $10^{-3}$ Pa to obtain a skeleton. A Cu—Ag alloy having a composition that the ratio of Cu:Ag is 2:1 was infiltrated into the skeleton at a temperature of 1000° C. for 0.5 hours under a vacuum of $10^{-3}$ Pa to obtain a sample of a contacts material.

CONDITION for Example 9

Zirconium powders and yttrium powders having an average grain size of 100 micrometers, respectively, were coated mechanically with molybdenum powders having an average grain size of 3 micrometers to prepare Composite powders. The following sintering and infiltration conditions were the same as in Example 6, and a sample of a contacts material was obtained.

Each of these contacts was found to have a conductivity and exhibit a circuit breaking capability of the same order as or better than that of the prior art Cu—Cr contacts.

Though not used specifically in the above-described Examples, Cr is found to be used as one of the arc-proof constituents of this invention.

From the results of studying the above Examples, it is clear that breaking capability can be improved not merely by the compositions of these Examples but also by employing at least one of CP, Ti, Zr, V, and Y as arc-proof material, at least one of Ta, Nb, W and Mo as auxiliary constituent, and at least one of Cu and Ag as conductive constituent.

As described above, according to this invention, contacts material for a vacuum valve of excellent breaking performance can be obtained.

Obviously, numerous modifications and variations of the present invention are possible in light of the above teachings. It is therefore to be understood that within the scope of the appended claims, the invention may be practiced otherwise than as specifically described herein.

What is claimed is:

1. A contacts material for a vacuum valve, comprising;

an arc-proof constituent comprising at least one selected from the group consisting of chromium, titanium, zirconium, vanadium and yttrium;

a conductive constituent comprising at least one selected from the group consisting of copper and silver;

an auxiliary constituent which does not react with said conductive constituent and which comprises at least one selected from the group consisting of tantalum, niobium, tungsten and molybdenum, said auxiliary constituent being formed to surround a periphery of said arc-proof constituent in said contacts material; and an amount of said arc-proof constituent being from 10% to 70% by volume;

a total amount of said arc-proof constituent together with said auxiliary constituent being not more than 75% by volume; and an amount of said conductive constituent being the balance.

2. The contacts material for a vacuum valve according to claim 1, wherein:

said arc-proof constituent and said auxiliary constituent have alloyed portions thereof in said contacts material.

3. The contacts material for a vacuum valve according to claim 2, wherein:

said arc-proof constituent and said auxiliary constituent have alloyed portions thereof at boundaries of said arc-proof constituent and said auxiliary constituent in said contacts material.

4. A contacts material for a vacuum valve, comprising:

composite powders, each including an auxiliary constituent and an arc-proof constituent covered with said auxiliary constituent; and a conductive constituent comprising at least one selected from the group consisting of copper and silver;

said arc-proof constituent comprising at least one selected from the group consisting of chromium, titanium, zirconium, vanadium and yttrium; and said auxiliary constituent comprising an element which does not react with said conductive constituent and which comprises at least one selected from the group consisting of tantalum, niobium, tungsten and molybdenum.

5. The contacts material for a vacuum valve according to claim 4, wherein:

an amount of said arc-proof constituent is from 10% to 70% by volume.

6. The contacts material for a vacuum valve according to claim 4, wherein:

a total amount of said arc-proof constituent together with said auxiliary constituent is not mope than 75% by volume.

7. The contacts material for a vacuum valve according to claim 5, wherein:

a total amount of said arc-proof constituent together with said auxiliary constituent is not more than 75% by volume.

* * * * *